United States Patent [19]

Lokkesmoe et al.

[11] Patent Number: 4,793,942

[45] Date of Patent: Dec. 27, 1988

[54] DETERSIVE SYSTEMS WITH A DISPERSED AQUEOUS-ORGANIC SOFTENING AGENT FOR HARDNESS REMOVAL

[75] Inventors: Keith D. Lokkesmoe, Burnsville; Keith E. Olson, Apple Valley, both of Minn.

[73] Assignee: Ecolab Inc., St. Paul, Minn.

[21] Appl. No.: 1,397

[22] Filed: Jan. 8, 1987

[51] Int. Cl.[4] ..... C11D 3/39; C11D 7/24; C11D 17/00

[52] U.S. Cl. ..... 252/99; 252/90; 252/95; 252/135; 252/142; 252/145; 252/155; 252/174.13; 252/174.14; 252/174.16; 252/174.23; 252/175; 252/181; 252/309; 252/544; 252/550; 252/554; 252/558

[58] Field of Search ..... 252/89.1, 175, 181, 252/174.16, 142, 309, DIG. 14, 95, 99, 135, 544, 90, 174.13, 174.14, 145, 550, 554, 558, 155

[56] References Cited

U.S. PATENT DOCUMENTS

| | | | |
|---|---|---|---|
| Re. 28,002 | 4/1974 | Li | 210/22 |
| Re. 30,179 | 12/1979 | Li et al. | 210/22 R |
| 3,389,078 | 6/1968 | Elzinga et al. | 208/308 |
| 3,410,794 | 11/1968 | Li | 208/308 |
| 3,617,546 | 11/1971 | Li et al. | 210/22 |
| 3,637,488 | 1/1972 | Li et al. | 210/22 |
| 3,740,315 | 6/1973 | Li et al. | 195/2 |
| 3,779,907 | 12/1973 | Li et al. | 210/22 |
| 3,923,678 | 12/1975 | Kleiner et al. | 252/174.16 |
| 3,969,265 | 7/1976 | Singhal et al. | 252/309 |
| 4,081,369 | 3/1978 | Li et al. | 210/22 R |
| 4,086,163 | 4/1978 | Cahn et al. | 210/22 D |
| 4,151,076 | 4/1979 | Reinhardt et al. | 210/21 |
| 4,183,960 | 1/1980 | Asher et al. | 424/365 |
| 4,235,713 | 11/1980 | Diaz Nogueira et al. | 210/638 |
| 4,259,189 | 3/1981 | Li | 210/643 |
| 4,287,071 | 9/1981 | Digiacomo | 210/643 |
| 4,292,181 | 9/1981 | Li et al. | 210/638 |
| 4,334,999 | 6/1982 | Cornwell | 210/638 |
| 4,337,225 | 6/1982 | Dines | 423/10 |
| 4,362,642 | 12/1982 | Carter et al. | 252/174.16 |
| 4,369,317 | 1/1983 | Hawkins | 544/110 |
| 4,379,041 | 4/1983 | Petranek et al. | 204/415 |
| 4,437,994 | 3/1984 | Baker | 210/638 |
| 4,461,709 | 6/1984 | Batzer et al. | 210/643 |
| 4,500,494 | 2/1985 | Scher | 423/24 |
| 4,540,448 | 10/1985 | Gautier et al. | 148/6.15 R |
| 4,555,343 | 11/1985 | Bauer et al. | 210/643 |
| 4,587,106 | 5/1986 | Bauer et al. | 423/8 |

OTHER PUBLICATIONS

G. F. Vandegrift and E. P. Horwitz; "The Mechanism of Interfacial Mass Transfer of Calcium in the System: Di(2-Ethylhexyl) Phosphate Acid in Dodecane-Dilute Nitric Acid ‡"; *Journal of Inorganic Nuclear Chemistry,* 1977, vol. 39, pp. 1425-1432.

I. Komasawa, T. Otake and Y. Higaki; "Equilibrium Studies of the Extraction of Divalent Metals from Nitrate Media with Di(2-Ethylhexyl) Phosphoric Acid"; *Journal of Inorganic Nuclear Chemistry,* 1981, vol. 43, pp. 3351-3356.

M. S. White and N. Lakshminarayanaiah; "Studies with Liquid Membranes: Association of Some Metal Ions with Phospholipids"; *Currents in Modern Biology,* 1969, pp. 39-44.

*Primary Examiner*—Prince E. Willis

*Attorney, Agent, or Firm*—Merchant, Gould, Smith, Edell, Welter & Schmidt

[57] ABSTRACT

Detersive systems that can be used to remove soil from fabrics, dishware, flatware, hard surfaces, clean-in-place installations, and other common household, institutional or industrial locations can contain a detergent capable of removing soil and a softening agent dispersed in the detergent comprising droplets having an exterior organic phase containing a complexing agent and an inner aqueous phase comprising an acid. The softening agent can adequately remove hardness ions from the detersive system made from the compositions of the invention.

52 Claims, 2 Drawing Sheets

DETERSIVE SYSTEMS WITH A DISPERSED AQUEOUS-ORGANIC SOFTENING AGENT FOR HARDNESS REMOVAL

FIELD OF THE INVENTION

The invention relates to the use of a detersive system containing a soil removing detergent and a dispersed aqueous-organic softening agent that can remove hardness from service water during detergent action. More specifically, the softening agent of the invention can be used to remove hardness cations from an aqueous medium or use solution containing a detersive system either before or during detergent action.

BACKGROUND OF THE INVENTION

Detersive systems have been used for many years in many cleaning environments including the laundry, warewashing, hard surface cleaning, and other applications. Typically, detersive systems are concentrates comprising mixtures of cleaning ingredients that when mixed with water form a cleaning medium or use composition. Service water, containing some concentration of hardness ions, supplied by local water utilities is most commonly used in making the use composition. Hardness ions are typically undesirable in conjunction with detersive systems since they interfere in the soil removal mechanism. The quality of service water varies from place to place throughout the country and can vary in hardness and can vary in the hardness components. Hardness typically comprises metal ions including calcium, magnesium, iron, manganese, and other typically divalent or trivalent metal cations depending on the source of the water. The presence of hardness cations in service water can substantially reduce the detersive action or effectiveness of a detersive system, can result in the incomplete cleaning of laundry, dishware, hard surfaces, and other soiled items or surfaces and can leave films or scale comprising the hardness cation and/or components of the detersive system.

A great deal of attention in recent years has been given to the components of detersive systems that reduce the effects of the hardness components. Common hardness sequestering agents comprise inorganic chemicals such as a condensed phosphate compound and a zeolite, and organic sequestrants such as EDTA, organic phosphonates and organic phosphinates. Such agents are effective in treating hardness in service water by a chemical reaction which keeps the ions in the aqueous bulk detersive system but reduces the hardness effect of the ions on the detersive systems. These agents can be effective but provide both economic and ecological disadvantages. Other hardness sequestering agents have been proposed in the prior art but have encountered economic, environmental, or compatibility problems in detersive systems.

Accordingly, a substantial need exists for hardness treating or softening agents that can be used in detersive systems at low concentration which can effectively soften service water through a mechanism of removing hardness ions from aqueous media used in detersive systems with no increase in cost, adverse environmental impact, or compatibility problems in detersive systems.

BRIEF DISCUSSION OF THE INVENTION

Figure 1:
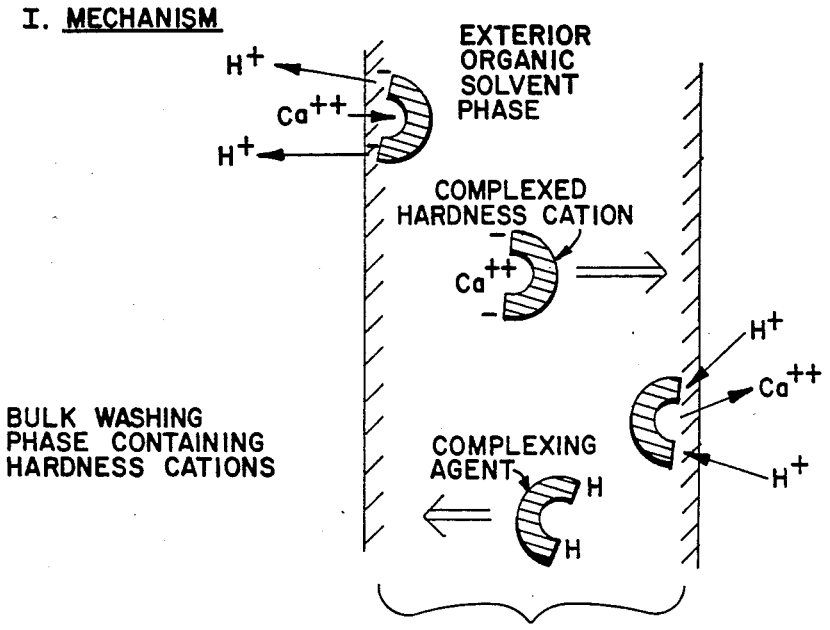
FIG. 1 is a depiction of the mechanism of hardness removal from a bulk aqueous washing phase.

We have found that a dispersion of an aqueous-organic hardness softening, hardness removing, or water softening, agent can be used in conjunction with detergent components. In an aqueous detersive system, the softening agent is a dispersion, in the bulk aqueous phase, of small liquid or solid organic droplets having an internal aqueous phase. In somewhat greater detail, the softening agent comprises a dispersion of small droplets having an exterior organic complexing phase, an inner acidic aqueous phase and a surfactant stabilizing the phase separation. The exterior organic phase comprises an organic medium which can be liquid or solid at room temperature and an organic soluble complexing agent that can bind hardness components. The inner acidic aqueous phase comprises an acid that acts as a sink or depository for hardness ions. Our current understanding of the mechanism of the action of the softening agent is as follows. At the interface between the organic phase and the bulk aqueous phase, the complexing agent first reacts with and extracts the hardness cations into the exterior organic phase, simultaneously releasing protons displaced from the complexing agent into the bulk phase. The hardness cation-complexing agent reaction product is then transferred by diffusion to the interface between the inner acidic aqueous phase and the exterior organic phase. There the hardness cations on the complexing agent are exchanged for protons. The cations remain in the aqueous phase. The protons regenerate the complexing agent for a repeat of the cycle (see FIG. 1). In this way, calcium, magnesium, iron, manganese, and other divalent or trivalent hardness cations can be transferred against a concentration gradient if the complexing agent has an affinity for the cation and a sufficient pH gradient exists between the inner aqueous phase of the softening agent through the organic phase to the bulk aqueous detersive system phase. Protons are thus transferred countercurrently to the hardness cations and provide a driving force to cause transfer of the hardness cations.

Briefly, in preparation, the inner acidic aqueous phase is first emulsified in the exterior organic phase containing an organic soluble complexing agent with a surfactant to stabilize the emulsion. The softening agent is then dispensed in the detergent composition. When the detergent composition is contacted with water to form a detersive system, the softening agent is then released into the use composition during the release of the detersive system. Alternatively the softening agent can be added to the wash medium separately from the detergent composition. The softening agent thus functions in the use composition as a water-in-oil-in-water emulsion. The emulsion is designed to be stable or to stay intact to soften the aqueous medium at least for the duration of a wash cycle process or step.

One aspect of this invention relates to a detersive system containing the softening agent. A second aspect of this invention relates to methods of making detersive systems containing the softening agent. A third aspect of this invention relates to a method of using a detersive system containing the softening agent, in an aqueous use medium for cleaning or soil removal purposes.

DETAILED DISCUSSION OF THE INVENTION

The detersive systems of our invention comprise a soil removing detergent and a dispersed softening agent having an inner acidic aqueous phase stabilized by a surfactant within an exterior organic complexing agent phase. The softening agents can be included in or used in conjunction with detersive systems formulated to clean dishware and flatware, laundry, clean-in-place equipment, hard surfaces, and other soiled articles or surfaces.

SOFTENING AGENT

The softening agent of the invention comprises two phases, an exterior organic phase and an inner acidic aqueous phase dispersed and contained within the exterior organic phase. The organic/aqueous phases of the softening agent are stabilized with a surfactant.

The softening agent contains a surfactant that can stabilize the dispersion of the inner aqueous phase in the exterior organic phase. Typically, the surfactant is present in the softening agent and appears at the interface between the organic phase and the inner aqueous phase. After the softening agent is prepared, the surfactant can be also present in both the aqueous and the organic phases. The stabilizing surfactant can be added to the organic phase during the preparation of the softening agent, and is typically mixed with the organic phase prior to the preparation of the softening agent. The inner acidic aqueous phase of the softening agent serves as a sink or depository to contain the hardness cations which have been extracted from the bulk aqueous washing phase by the complexing agent. If substantial amounts of the aqueous phase of the softening agent are released into the bulk aqueous phase during cleaning, the extent of softening can be substantially reduced.

The surfactant can be used at a concentration of about 0.01 to about 50 wt-% based on the total weight of the organic phase. Preferably, the amount of surfactant used ranges from about 1 to 20 wt-% of the organic phase and most preferably, for reasons of economy and emulsion stability, about 3 to 15 wt-% of the stabilizing surfactant is used based on the total weight of the organic phase. The exterior organic solvent phase can comprise from about 25 to 95 vol-% of the softening agent. The inner acidic aqueous phase can comprise from about 5 to 75 vol-% of the softening agent. Preferably the exterior organic solvent phase comprises from about 25 to 75 vol-% of the softening agent. Preferably the inner acidic aqueous phase comprises from about 25 to 75 vol-% of the softening agent.

We have found that smaller droplet sizes yield greater rates of softening due to an increased surface area increasing the rate of extraction of hardness. We have also found that the use of smaller amounts of the softening agent is preferred since the softening agent contains an organic solid or a liquid solvent such as an oil. The softening agent can have a droplet size of from about 0.05 to 2000 microns, preferably from about 1.0 to 1000 microns, and most preferably to reduce the amount of organic and increase rate of softening the droplet size is about 1 to 500 microns.

EXTERIOR ORGANIC PHASE

The exterior organic phase of the softening agent comprises a liquid, semi-solid or solid organic medium, at room temperature, and a effective amount of an organic soluble complexing or chelating agent. In the detersive systems of the invention, the softening agent can either be liquid or solid at room temperature. At use temperature the softening agent is preferably liquid or semi-liquid. Alternatively the softening agent can be a semi-solid or solid matrix, that can protect the softening agent from shear forces, with a separate liquid phase contained within the solid matrix which allows the diffusion of the cation-complexing agent reaction product through the pores of the solid matrix. The exterior organic solvent phase can comprise about 20 to 99.8 wt-% of an organic medium and about 0.1 to 40 wt-% of a complexing agent. Preferably the organic medium phase comprises about 75 to 98 wt-% of an organic medium, and about 1 to 25 wt-% of a complexing agent or mixtures thereof.

Organic compositions useful in the exterior organic phase of the softening agent include essentially organic liquids, solids and semi-solids in which the hardness ion complexing agent are soluble. Useful liquid organics include compositions having a flash point preferably in excess of 200° F. Such liquids typically come in the form of a light, chemically inert oil of low volatility. Preferred organic phases comprise saturated paraffinic or naphthenic organic liquids and solids. Most importantly the organic phase should be non-toxic, non-reactive with the acid of the inner aqueous phase, and have low solubility in the aqueous phase. Broadly, compounds that can be used as the organic phase include paraffinic hydrocarbons, naphthenic hydrocarbons, fatty acids and fatty alcohols that can be both liquid and solid at room temperature, including waxes, hydroxy waxes, fluorocarbon solvents, acid stable silicone oils and others. Most preferred organic solvents include light petroleum oils, paraffinic waxes, highly refined white oils and mixtures thereof.

In certain instances, a wax composition can be used as the sole component of the exterior organic phase or as an encapsulate in conjunction with a second, exterior organic phase component. Wax which is typically a saturated hydrocarbon compound solid at room temperature but melting prior to typical cleaning temperatures of bulk aqueous phase, can be used as the organic phase or in conjunction with a liquid organic phase where additional stability of the softening agent is required. In granular systems, the softening agent can be prepared in a wax form stabilizing the emulsion within the wax particle. In liquid or solid detersive systems, the wax at room temperature can remain in solid form and can protect the organic components of the softening agent from any adverse interaction with the cleaning components of the detersive systems.

Historically waxes are known to include substances that are natural and synthetic products. Chemically naturally occurring waxes are esters of fatty acids and monohydric fatty alcohols, relatively high molecular weight monohydric fatty alcohols, and other components. Modern synthetic waxes typically include saturated hydrocarbons having aliphatic or open chain structures with relatively low branching or side chains. Physically waxes are water repellant solids at room temperature having a useful degree of plastic character. Particularly preferable waxes for use in the softening agent compositions of the invention are petroleum waxes, beeswax, microcrystalline wax, slack wax, and paraffin wax. Particularly useful waxes are solids at room temperature but have softening points or melting points at the temperature of use of the detersive system, commonly above about 100° F., preferably 120°. The softening agents of the invention typically have highest efficiency when the wax is melted, resulting in a liquid phase for the efficient transfer of hardness components of service water into the interior inner aqueous phase.

A room temperature solid wax can be used in conjunction with a second organic composition in different modes including: (1) with a wax that can melt at use temperature, (2) with an organic solid or semi-solid matrix, and (3) with two waxes, a first wax having a melting point below the temperature of use solution and a second wax having a melting point above the use solution.

In detersive systems having greater than 500 ppm or greater than 200 ppm aqueous cleaning surfactant or organic detergent the use of wax as the organic phase or as an organic phase encapsulate is preferred.

COMPLEXING AGENT

The complexing agent serves to extract hardness cations from a bulk aqueous phase into the exterior organic solvent phase while simultaneously releasing protons into the bulk washing phase. The complexed hardness cations are then transferred to the inner acidic aqueous phase where they are exchanged for protons.

Virtually any complexing agent soluble in the organic phase of the softening agent of the invention and reactive with the di- and trivalent metal ions comprising aqueous hardness components can be used in the softening agents of the invention. Complexing or chelating agents simply stated are organic or inorganic molecules or ions (ligand) that can coordinate a metal ion in more than one position. Coordination is a particular chemical reaction in which a ligand through two or more electron donor groups can bind to a metal ion. Primarily chelating or complexing agents comprise organic ligand groups having efficient functional donor groups that can react with and stabilize metal ions. Many organic and inorganic chelating agents are shown, for example, in Baker, U.S. Pat. No. 4,437,994 at column 7, lines 7–69, columns 8–11, and column 12, lines 1–4, and in Kirk-Othmer *Encyclopedia of Chemical Technology,* 2nd Ed., Vol. 6, pp. 1–24.

Examples of complexing agents useful in the exterior organic solvent phase of the liquid softening agent include but are not limited to the following: alkyl substituted phosphorous acid such as a phosphoric, phosphonic, and phosphinic acid, alkyl substituted sulfuric and sulfonic acids, mono-, di- and tricarboxylic agents and alkyl substituted mono-, di- and tricarboxylic acids, salts thereof and mixtures thereof.

INNER ACIDIC AQUEOUS PHASE

An inner acidic aqueous phase is contained within the exterior organic phase of the softening agent. The inner acidic aqueous phase can comprise from about 1 to 99.5 wt-% water and from about 0.5 to 99 wt-% acid. The excess acid in the inner aqueous phase over the bulk aqueous phase provides the driving force for the softening effect. Depending on end use and hardness of service water the inner acidic aqueous phase can comprise concentrated acid or from about 50 to 90 wt-% water and from about 10 to 50 wt-% acid. Both organic and inorganic acids can be used. Examples of acid which can be used in the inner acidic aqueous phase include but are not limited to the following: hydrochloric acid, sulfuric acid, sulfamic acid, phosphoric acid; a carboxylic acid such as citric acid, acetic acid, trihaloacetic acid, acrylic acid, polyacrylic acid polymers, or mixtures thereof.

DETERSIVE SYSTEMS

The liquid softening agents of this invention can be included in or used in conjunction with a detersive system. Detersive systems are concentrates that comprise a combination of ingredients that can be used primarily in dilute form in aqueous media and can act to remove soil from a substrate. The detersive systems of this invention are typically in the form of a liquid, a particulate, or solid. Liquids include flowable compositions including solutions, both dilute and concentrated, suspensions, gels and slurries. Particulates include products made by particle mixing, dry blending and granulation. Solids include cast solids, extrudates, pellets, or compressed solids.

A detersive system typically contains a detergent which is a chemical compound that can weaken or break bonds between soil and a subtrate. Organic and inorganic detergents include surfactants, solvents, alkalis, basic salts and other compounds. A detersive system is typically used in a liquid cleaning stream, spray, bath, etc. which produces an enhanced cleaning effect that is caused primarily by the presence in the bath of a special solute (the detergent) that acts by altering the interfacial effects at the various phase boundaries (i.e. between soil, substrate and both) within the system. The action of the bath typically involves more than simply soil dissolution. The cleaning or washing process in a typical detersive system usually consists of the following sequence of operations. The soiled substrate is immersed or otherwise introduced into or contacted by a large excess of a bath containing a detergent solute. The soil and the underlying object or substrate typically becomes thoroughly wetted by the bath. The system is subjected to mechanical agitation by rubbing, shaking, spraying, mixing, pumping or other action to provide a shearing action which aids in the separation of the soil from the substrate. The bath now containing the soil is typically removed from the object to be cleaned, the object is rinsed and often dried.

Detersive systems are often used in cleaning hard surfaces such as sinks, tiles, windows, and other glass, ceramic, plastic or other hard surface dishware, and laundry or other textiles. Soils removed from substrates by the detersive systems are extremely variable in composition. They may be liquid, solid or a mixture thereof. The soils typically consist of mixtures of proteinaceous, carbohydrate, and fatty materials typically in combination with inorganic components and some water.

Detersive baths typically contain a detergent which is often an organic surfactant detersive component, an inorganic detersive component, or combinations of organic and inorganic components, and can typically be used in combination with other organic and inorganic components that provide additional properties or enhance the basic detersive property of the detersive component. The compositions dissolved or suspended in water to provide detersive systems are formulated to suit the requirements of the soiled substrate to be cleaned and the expected range of washing conditions. Few cleaning systems have a single component. Formulated detersive systems consisting of several components often out-perform single component systems. Materials which can be used independently in detersive systems are as follows:

(a) surfactants including various synthetic surfactants and natural soaps;

(b) inorganic builders, diluents, or fillers including salts, acids and bases;

(c) organic builder additives which enhance detergency, foaming power, emulsifying power, soil suspension;

(d) special purpose additives such as bleaching agents, brightening agents, enzymes, bactericides, anticorrosion agents, emollients, dyes, fragrances, etc.; and (e) hydrotrope solubilizers used to insure a compatible uniform mixture of components including alcoholic cosolvents, low molecular weight anionic surfactants, emulsifying agents, etc. When blending the detersive components and the softening agent, enhanced compatibility and stability can be achieved if the specific gravity of the liquid detersive system matches the specific gravity of the softening agent.

ORGANIC SURFACTANT

The detersive systems of this invention can include an organic surfactant in combination with or in conjunction with the aqueous/organic softening agent.

Preferred surfactants are the nonionic, anionic, and cationic surfactants. Cationic surfactants such as quaternary ammonium compounds are frequently used in detersive systems but are typically not cleansing ingredients and are used for purposes such as sanitizing or fabric softening.

Soil removing surfactants useful with the softening agents of this invention in the detersive systems comprise soaps, i.e. (a) sodium or potassium salts of fatty acids, rosin acids, and tall oil; (b) alkylarene sulfonates such as propylene tetramerbenzene sulfonate; (c) alkyl sulfates or sulfonates including both branched and straight chain hydrophobes as well as primary and secondary sulfate groups; (d) sulfates and sulfonates containing an intermediate linkage between the hydrophobic and hydrophilic groups such as taurides and sulfonated fatty mono glycerides, long chain acid esters of polyethylene glycol, particularly a tall oil ester; (f) polyalkylene glycol ethers of alkyl phenols wherein the alkylene group is derived from ethylene or propylene oxide or mixtures thereof; (g) polyalkylene glycol ethers of long chain alcohols or mercaptans, fatty acyl diethanolamides; (h) block copolymers of ethylene oxide and propylene oxide; and others.

Preferred examples of nonionic surfactants include the following: $C_{6-12}$ alkyl phenol ethoxylates and/or propylates, EO/PO block copolymers (pluronic and reverse pluronics), or mixtures thereof.

INORGANIC COMPOUNDS

Detersive systems can contain inorganic detergent compounds which are typically grouped into the following six categories: alkalis, phosphates, silicates, neutral soluble salts, acids, and insoluble inorganic builders.

Sources of alkalinity useful in combination with or in conjunction with the liquid softening agents of the invention include but are not limited to the following: alkali metal hydroxides, alkali metal carbonates, alkali metal bicarbonates, alkali metal sesquicarbonate, alkali metal borates, and alkali metal silicate. The carbonate and borate forms are typically used in place of alkali metal hydroxide when a lower pH is desired. Silicates ($Na_2O:SiO_2$ compounds) which are typically a reaction product between sodium hydroxide and silica, have a variety of $Na_2O:SiO_2$ reaction molar ratios. Silicates are primarily used as alkalis and as builders in both warewashing and laundry formulations. We have found that the addition of base can aid in dispersing the softening agent in detersive systems.

Threshold agents can be useful in conjunction with or in combination with the softening agents of the invention include organic and inorganic carboxylates, phosphates, phosphonates and mixtures thereof. Such agents include but are not limited to the following: organic acrylate polymers, phosphinic and phosphonic acids, inorganic phosphate compositions including monomeric phosphate compounds such as sodium orthophosphate and the higher condensed phosphates including tetraalkali metal pyrophosphates, sodium tripolyphosphate, glassy phosphates and others. Threshold agents are typically used at low concentration, about 0 to 50 ppm, in order to slow or delay the formation of deposits of hardness components through a much less than stoichiometric reaction between the threshold agent and the inorganic components of hardness in service water. Phosphates are typically used as sequestering, suspending and cleaning agents. Sodium tripolyphosphate is the most widely used builder in heavy duty detergents.

Neutral soluble salts which are typically the reaction product of a strong acid and a strong base including sodium sulfate, sodium chloride, and others in conjunction with or in combination with the detersive systems of the invention. Neutral soluble salts are typically used as builders or diluents in synthetic surfactant based detersive compositions.

Insoluble inorganic builders are often used in liquid, gel and solid detersive systems. The insoluble inorganics including clays, both natural and synthetic, such as montmorilonite clay or bentonite clay, can have a detersive effect in certain systems. Further, they can be used as suspending agents to maintain or stabilize a liquid or gelled system.

ORGANIC BUILDERS AND ADDITIVES

Further, the detersive systems can contain organic builders and other special purpose additives. This class of compound is typically organic molecules having little detersive nature but containing many other desirable properties including antiredeposition additives, sequestrants, antifoaming or foaming additives, whiteners and brighteners, additives or hydrotropes for maintaining the solubility of components, and additives for protecting both the substrate and the washing apparatus. The most common organic additives include organic sequestrants and organic antiredeposition agents. Organic sequestrants include compositions such as polyacrylic acid and methacrylic acid polymers, ethylene diamine tetraacetic acid, nitrilotriacetic acid, etc. and others.

SOURCES OF ACTIVE CHLORINE

Sources of active chlorine useful in conjunction with or in combination with the liquid softening agent of the invention include but are not limited to the following: alkali metal and alkaline earth metal hypochlorite, chlorinated condensed phosphates, dichloroisocyanurate, chlorinated cyanurate, and mixtures thereof. Specific examples of active chlorine sources include the following: sodium hypochlorite, calcium hypochlorite, chlorinated sodium tripolyphosphate and mixtures thereof.

Common detersive systems in use today are laundry systems, industrial, institutional and household dishwashing or warewashing compositions, clean-in-place and hard surface cleaning compositions. The softening agents of the invention can be used in all of these detersive systems.

In aqueous dishwashing, detersive solutions are prepared from typically liquid, particulate or solid detersive systems by the action of water within a warewashing machine. The softening agent of this invention can be used in detersive compositions prepared from solid, particulate or liquid warewashing cleaners.

Dishwashing detersive systems typically comprise a source of alkali in the form of an alkali metal hydroxide, alkali metal carbonate, or alkali metal silicate in combination with a hardness sequestering agent, optional surfactants, a source of active halogen, and other optional chemical substances. The softening agents of this invention can effectively be used in warewashing detersive systems.

An aqueous surfactant and the softening agent of this invention can be used in a clean-in-place-cleaning environment in which the chemical properties of the aqueous surfactant and liquid softening agent solution pumped into and through a site requiring cleaning are relied on to the exclusion of mechanical soil removing processes in order to clean pipelines, process equipment, storage tanks, and other enclosed easily soiled locations. Such applications require significant detergency and stability to chemical soils.

The softening agents of the present invention can be used in laundry detersive systems. Laundry detersive systems typically in the form of liquid, particulate or solid compositions can be used in both household and institutional laundry equpiment to clean and destain typically soiled fabric articles. Cleaning of such articles is typically accomplished by removing soil that is physically associated with the fabric and by destaining or bleaching soils that cannot be removed by typical detersive systems. Laundry compositions typically comprise anionic or nonionic surfactants, water, softening or hardness sequestering agents, foam stabilizers, pH buffers, soil suspending agents, perfumes, brighteners, opacifiers, and colorants. If the laundry detersive system is in liquid form typically the components are dissolved or suspended in water, while if in a gelled form the water solution is typically combined with a gelling agent.

Further, the softening agents of this invention can be used in a variety of liquid detergent compositions that can be used in a variety of environments including hard surface cleaning, hand cleaning, general household cleaning, car washing, recreational equipment cleaning, etc. Such detersive systems are used in the form as shown below or in aqueous solution prepared from the compositions as shown below.

TABLE A

Hard Surface Cleaner
Surfactant - Softening Agent Composition

| Component | Useful Wt-% | Preferred Wt-% | Most Preferred Wt-% |
|---|---|---|---|
| Surfactant | 0.1–95 | 0.5–20 | 0.5–10 |
| Softening agent | 0.1–40 | 1–30 | 10–30 |
| Water | Balance | Balance | Balance |

TABLE B

Warewashing Cast (or C—I—P) Composition

| Component | Useful Wt-% | Preferred Wt-% | Most Preferred Wt-% |
|---|---|---|---|
| Source of alkalinity | 5–70 | 10–60 | 20–50 |
| Chlorine source | 0.1–15 | 1–10 | 1–5 |
| Softening agent | 1–60 | 2–50 | 3–40 |
| Water | Balance | Balance | Balance |

TABLE C

Laundry Granular Composition

| Component | Useful Wt-% | Preferred Wt-% | Most Preferred Wt-% |
|---|---|---|---|
| Surfactant | 0.1–50 | 1–40 | 1–25 |
| Source of alkalinity | 0.1–95 | 1–40 | 10–40 |
| Semi-solid wax based softening agent | 1–60 | 2–50 | 2–40 |

TABLE D

Detersive Composition

| Component | Useful Wt-% | Preferred Wt-% | Most Preferred Wt-% |
|---|---|---|---|
| Source of alkalinity | 0.1–60 | 0.5–50 | 1–40 |
| Surfactant | 0.5–10 | 1–5 | 1–4 |
| Chlorine source | 0.5–10 | 1–5 | 1–4 |
| Softening agent | 1–60 | 2–50 | 3–40 |

TABLE E

Liquid Softening Agent

| | Useful | Preferred | Most Preferred |
|---|---|---|---|
| | Vol-% | Vol-% | Vol-% |
| Component | | | |
| EXTERIOR ORGANIC PHASE | 80–25 | 75–25 | 60–25 |
| INNER ACID PHASE | 20–75 | 25–75 | 40–75 |
| | Wt-% | Wt-% | Wt-% |
| EXTERIOR PHASE Components: | | | |
| Organic Solvent | 0.1–99.9 | 20–99 | 25–90 |
| Complexing agent | 0.1–99.9 | 1–50 | 1–40 |
| Surfactant | 0.1–50 | 1–30 | 1–20 |
| INNER AQUEOUS PHASE Components: | | | |
| Acid | 0.1–99 | 0.5–80 | 10–70 |
| Water | Balance | Balance | Balance |

The following Examples further illustrate the invention and provide a best mode.

EXAMPLE I

A liquid softening agent was prepared having the following composition:

50 Wt-% Organic Solvent Phase:

82.6 wt-% light mineral oil (Carnation TM mineral oil, Witco)

11.4 wt-% di-2-ethyl-hexylphosphoric acid (DEHPA complexing agent)

4.0 wt-% poly(ethyleneimine) (M.W. about 2000, Paranox 105, Exxon surfactant)

2.0 wt-% sorbitan mono oleate, (Span 80, ICI America surfactant)

50 Wt-% Inner Aqueous Acidic Phase:

6N HCl in deionized water

The liquid softening agent was prepared by first dissolving the DEHPA complexing agent in the mineral oil and then adding the polyimine surfactant and the sorbitan monooleate surfactant. The organic solvent phase was agitated until the components were fully dispersed. The 6N HCl was then slowly added to the organic phase under very high shear agitation. The resulting emulsion was agitated for about 2 minutes after all of the acid was added to insure breakdown of the acid into very small droplets.

An aqueous water phase having a synthetic hardness of 240 ppm of $CaCO_3$ was used. The surfactant nonylphenol 9.5 ethoxylate (about 9.5 equivalents of ethylene oxide, IGEPOL CO-630) was added to the water in an amount sufficient to produce a concentration of the surfactant of 50 ppm. The liquid softening agent (1 wt-% based on the bulk water phase) was added to the water simultaneously with an alkaline source comprising a sodium hydroxide solution in a sufficient amount to produce a concentration of 1200 ppm NaOH. The water temperature was 90°-95° F.

Figure 2:
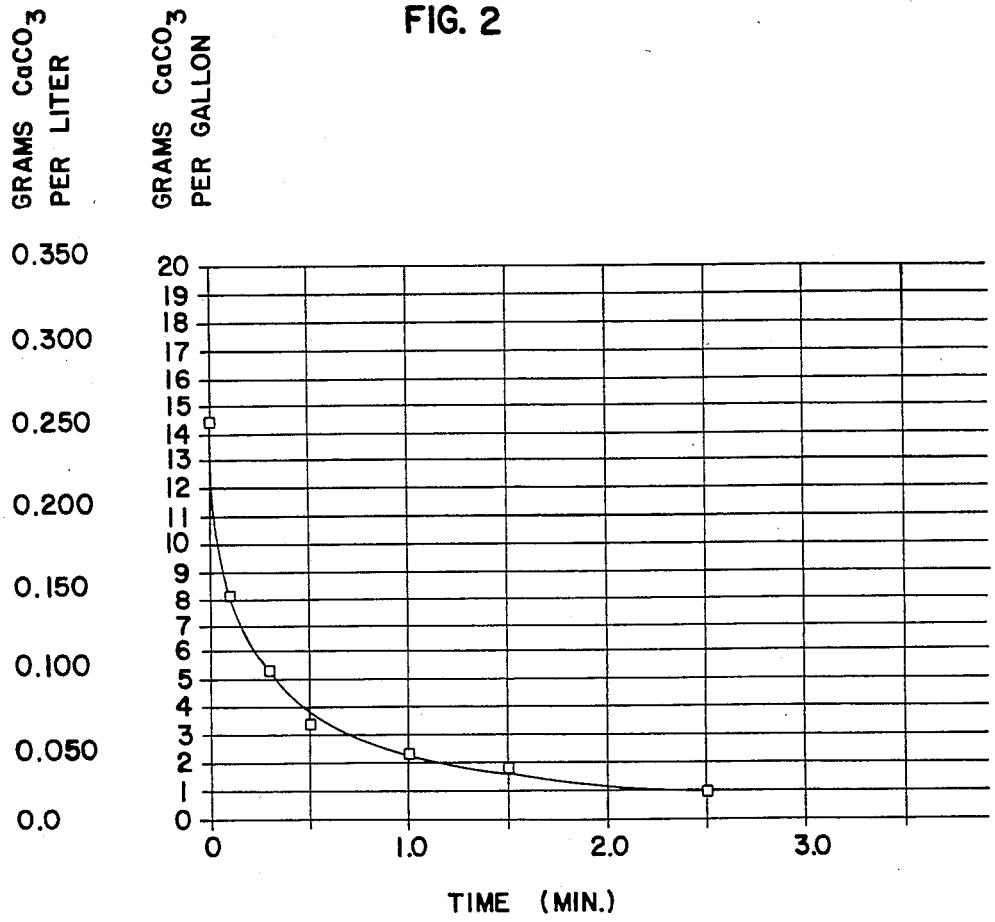
FIG. 2 is a graphical representation showing the softening properties of the softener of Example I.

The amount of calcium ion removed from the bulk solution by the softening agent was measured at various time intervals. Table F (below) and FIG. 2 reveals that a substantial removal of hardness ($Ca++$) occurred in the 25 minute time period. The bulk aqueous phase having alkalinity and a surfactant was softened below 3 grain/gallon $CaCO_3$ in 7 minutes and below 1 grain/gallon in 25 minutes. By mass balance, there was $1.40\times10^{-3}$ total moles of calcium ion extracted, with $1.13\times10^{-3}$ moles of DEHPA available. Assuming a coordination factor of 4 in the DEHPA/Ca complex, 86% of the calcium ion was transferred into the inner acidic aqueous phase, yielding a calcium concentration in the inner acidic aqueous phase that reached 0.41 moles/liter. The calcium ion was thus being transferred from a solution of $1.6\times10^{-4}$M into a solution of 0.41M at the end of the experiment, a concentration differential of more than three orders of magnitude, and a concentration factor of 2560.

TABLE F

| | | Softening Performance | | |
|---|---|---|---|---|
| Time (Minutes) | Volume (ml) | Loading Aqueous pH | Grains/ Gallon (as $CaCO_3$) | Grams/ Liter (as $CaCO_3$) |
| 0 | 640 | 7.50 | 14.4 | 0.247 |
| 1 | 626 | 12.00 | 8.1 | 0.139 |
| 3 | 612 | 12.00 | 5.3 | 0.091 |
| 5 | 598 | 12.00 | 3.4 | 0.058 |
| 10 | 584 | 12.00 | 2.3 | 0.039 |
| 15 | 570 | 12.00 | 1.8 | 0.031 |
| 25 | 556 | 12.00 | 0.9 | 0.015 |

EXAMPLE II

In the following experiment the softening agent of the invention is combined in a solid warewashing detergent formulation.

Into a vessel was placed 3 parts of deionized water and 36 parts of 50 wt-% aqueous sodium hydroxide. The mixture was stirred and into the stirred caustic solution was placed 56 parts of sodium hydroxide beads followed by 5 parts of the softening agent prepared in Example I. The mixture was stirred until uniform and then when stirring was withdrawn the mixture hardened until solid into a cast solid detergent.

Into 250 milliliters of a synthetic tap water (300 ppm calcium carbonate in deionized water) was placed 28.34 g. of the cast solid detergent in a single portion. The wash solution thus contained 0.57% of the softening agent. The temperature of the bulk solution was maintained at about 110° F., and the bulk solution in a 400 milliliter glass beaker having a stainless steel baffle and agitator was continuously agitated. Samples of the bulk solution were withdrawn at regular intervals for the purpose of determining hardness. The results of the experiment is shown below in Table G.

TABLE G

| | | Softening Performance | | |
|---|---|---|---|---|
| Time (Min.) | Volume (ml) | Loading Aqueous pH | Grains/ Gal (as $CaCO_3$) | Grams/ Liter (as $CaCO_3$) |
| 0 | 240 | 6.0 | 17.4 | 0.300 |
| 2 | 230 | 13.0 | 9.3 | 0.160 |
| 5 | 220 | 13.0 | 5.3 | 0.091 |
| 10 | 210 | 13.0 | 4.9 | 0.084 |
| 20 | 200 | 13.0 | 4.3 | 0.073 |
| 40 | 190 | 13.0 | 4.4 | 0.075 |
| 60 | 180 | 13.0 | 4.3 | 0.073 |

75% of the hardness ions were removed in 20 minutes with no apparent release of calcium ions from the inner aqueous phase of the softening agent into the use solution. The very high sodium loading in the use solution did not interfere with calcium exchange. Further, the softening agent survived solidification of the highly caustic detergent system. In this procedure the samples taken were not filtered and were acidified to dissolve any calcium salts that may have precipitated before the analysis was done to insure that an accurate measurement of total calcium removal by the softening agent was obtained.

EXAMPLE III

A liquid softening agent was prepared having the following composition:

50 wt-% organic solvent phase:
82.6 wt-% light mineral oil (KLEAROL, Witco Co.);
11.4 wt-% di-2-ethylhexyl phosphoric acid (DEHPA);
4.0 wt-% polyimine;
2.0 wt-% sorbitan monooleate (SPAN 80, ICI America);
50 wt-% inner aqueous acidic phase:
6 molar HCl in deionized water.

The liquid softening agent was prepared by first dissolving the DEHPA complexing agent in mineral oil and then adding the additional surfactants. The organic softening phase was agitated until the components were fully dispersed. The 6N HCl was then slowly added to the organic phase under very high shear agitation. THe resulting emulsion was agitated for two minutes after all the acid was added to insure the acid was present in the form of small droplets.

A bulk aqueous phase having a synthetic hardness of 200 ppm of calcium carbonate was used. To the bulk water phase was added sufficient sodium hydroxide to introduce a concentration of 500 ppm NaOH. Into the bulk aqueous phase was placed sufficient softening agent to create 2000 ppm concentration. The water temperature was about 130° F. The amount of calcium ion removed from the bulk solution by the softening agent was measured at various time intervals. As shown in the following Table, 70% of the hardness ion was removed within the first minute. The lower viscosity of the Klearol mineral oil contributed to the hardness removal rate. Ninety-five mole-% of the calcium orginally in the bulk aqueous phase was transferred to the inner aqueous phase of the softening agent in the presence of as little as 2000 ppm softening agent.

TABLE H

| Time (Min.) | Volume (ml) | Softening Performance: Loading Aqueous pH | Grains/ Gal (as $CaCO_3$) | Grams/ Liter (as $CaCO_3$) |
|---|---|---|---|---|
| 0 | 245 | 8.34 | 11.3 | 0.200 |
| 1 | 240 | 8.97 | 3.8 | 0.065 |
| 3 | 235 | 9.13 | 3.2 | 0.055 |
| 5 | 230 | — | 2.2 | 0.038 |
| 10 | 225 | 8.45 | 1.6 | 0.028 |
| 15 | 220 | — | 1.4 | 0.024 |
| 25 | 215 | 8.4 | 1.9 | 0.03 |

EXAMPLE IV

A softening agent was prepared having the following composition:

50 wt-% organic wax phase:
84% paraffin wax (m.p. 132°-142° F.)
10% DEHPA
4% polyimine
2% sorbitan monooleate
50 wt-% aqueous phase:
6N HCl Example III was repeated exactly except that wax melting at 145° F. was substituted for the mineral oil in the organic phase. Further, in the bulk aqueous phase the nonyl phenyl 9.5 ethoxylate surfactant was omitted and the concentration of calcium carbonate was 0.230 g. per liter. The following table details the softening performance of the wax based softening agent.

TABLE I

| Time (Min.) | Volume (ml) | Softening Performance: Loading Aqueous pH | Grains/ Gal (as $CaCO_3$) | Grams/ Liter (as $CaCO_3$) |
|---|---|---|---|---|
| 0 | 250 | 8.18 | 13.7 | 0.235 |
| 1 | 245 | 11.2 | 6.8 | 0.117 |
| 5 | 240 | 11.2 | 6.8 | 0.117 |
| 15 | 235 | 11.1 | 6.8 | 0.117 |

The Table shows a transfer of more than 50% of the calcium hardness in the first minute.

EXAMPLE V

Example III was repeated except that the softening agent was used at 2.0 wt-%, NaOH was used at 38 ppm, the nonionic surfactant was used at 20 ppm and the total hardness in the bulk aqeuous phase was about 6.5 grains per gallon of a mixture of calcium and magnesium or about $7.6\times10^{-4}$ molar in calcium and $3.6\times10^{-4}$ molar in magnesium. The bulk aqueous phase was made by blending 85 g. of hard water and 170 g. of deionized water.

TABLE J

| Time (Min.) | Volume (ml) | Softening Performance: Loading Aqueous pH | Grams/ Gal (as $CaCO_3$) | Grams/ Liter (as $CaCO_3$) |
|---|---|---|---|---|
| 0 | 255 | 9.05 | 6.5 | 0.110 |
| 1 | 245 | 5.8 | 3.2 | 0.055 |
| 3 | 235 | 2.4 | 1.2 | 0.021 |
| 5 | 225 | 2.4 | 1.1 | 0.019 |
| 10 | 215 | 2.5 | 1.1 | 0.019 |
| 20 | 205 | 2.3 | 1.1 | 0.019 |

TABLE J-continued

| Time (Min.) | Volume (ml) | Softening Performance: Loading Aqueous pH | Grams/ Gal (as $CaCO_3$) | Grams/ Liter (as $CaCO_3$) |
|---|---|---|---|---|
| 30 | 195 | 2.2 | 1.1 | 0.019 |

Figure 3:
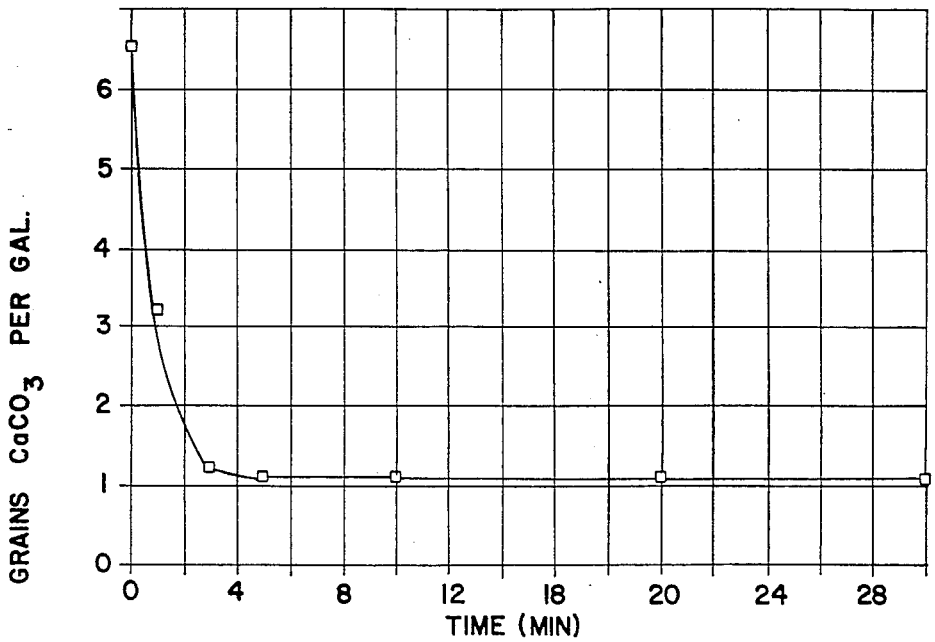
FIG. 3 is a graphical representation showing the softening properties of the softener of Example V.

Clearly, hard water containing both magnesium and calcium ions was successfully softened using the softening agent. An analysis of the bulk aqueous phase determined that 100 mole-% of the $Ca++$ and 79 mole-% of the magnesium were removed from aqueous solution by the organic aqueous softening agent. Multiple ions can clearly be simultaneously transferred from wash water into the internal aqueous phase in the presence of substantial concentrations of both alkalinity and surfactant at reasonable softener concentrations. A graph of the softening effect found in this experiment is shown in FIG. 3.

While the invention has been explained fully in the detailed discussion found above of the specific embodiments of the invention, many embodiments of the invention can be made without departing from the spirit and scope of the invention. The invention resides in the claims hereinafter appended.

We claim:

1. A detersive system, that can remove divalent or trivalent ions from service water and can clean soiled surfaces or articles, comprising:
   (a) an effective detersive amount of a soil removing detergent;
   (b) an effective amount of a softening agent, dispersed in the detergent, which softening agent comprises:
      (1) about 25 to 95 vol.-% of an exterior organic phase having:
         (i) an organic medium; and
         (ii) about 0.1 to 99 wt-% based on the organic phase of an organic soluble hardness ion complexing agent;
      (2) about 5 to 75 vol.-% of an inner acidic aqueous phase dispersed within the exterior organic solvent phase which comprises:
         (i) water; and
         (ii) about 0.5 to 99 wt-% based on the aqueous phase of an acid; and
      (3) about 0.1 to 50 wt-% based on the organic phase of a surfactant that can stabilize the dispersed aqueous phase within the exterior organic phase.

2. The detersive system of claim 1 wherein the softening agent comprises droplets having a droplet size of about 0.05 to 2,000 microns.

3. The detersive system of claim 1 wherein the softening agent comprises droplets having a droplet size of about 1 to 1,000 microns.

4. The detersive system of claim 1 wherein the detersive system is a solid.

5. The detersive system of claim 1 wherein the detersive system is a liquid.

6. The detersive system of claim 1 wherein the soil removing detergent comprises a surfactant selected from the group consisting of nonionic surfactant, cationic surfactant, and anionic surfactant and mixtures thereof.

7. The detersive system of claim 1 wherein the soil removing detergent comprises an inorganic detergent selected from the group consisting of an alkaline metal silicate, an alkaline metal hydroxide, an alkaline metal carbonate, an alkaline metal bicarbonate, and mixtures thereof.

8. The detersive system of claim 2 wherein the organic medium is selected from the group consisting of a liquid paraffinic hydrocarbin, a napthenic hydrocarbon, petroleum white oil, a wax, a silicone oil, a halogenated paraffin, a fatty acid, and mixtures thereof.

9. The detersive system of claim 8 wherein the complexing agent is selected from the group consisting of an alkyl substituted phosphorus acid compound, an alkyl substituted sulfonic acid compound, a carboxylic acid compound, or salts thereof and mixtures thereof.

10. The detersive system of claim 9 wherein the alkyl substituted phosphorus acid is an alkyl substituted phosphoric acid, alkyl substituted phosphonic acid, alkyl substituted phosphinic acid, salts thereof or mixtures thereof.

11. The detersive system of claim 10 wherein the alkyl substituted phosphoric acid is di-2-ethyl-hexyl-phosphoric acid.

12. The detersive system of claim 5, wherein the acid, of inner acidic aqueous phase, is selected from the group consisting of hydrochloric acid, sulfuric acid, phosphoric acid, a carboxylic acid compound, and mixtures thereof.

13. The detersive system of claim 5 wherein the surfactant that can stabilize the dispersed inner aqueous phase comprises alkyl substituted polyethyleneimine or alkyl substituted amine.

14. A warewashing detersive system, capable of removing soil from flatware or dishware and removing divalent or trivalent ions from service water, comprising:

(a) about 0.1 to 95 wt-% of a source of an inorganic alkaline detergent;

(b) about 2 to 60 wt-% of a softening agent dispersed in the detersive system, which softening agent comprises:

(1) about 25 to 95 vol.-% of an exterior organic phase comprising a major proportion of an organic medium and about 0.5 to 45 wt-% of an organic soluble hardness ion complexing agent;

(2) about 5 to 75 vol.-% of an inner acidic aqueous phase dispersed within the exterior organic solvent phase which comprises water and about 0.5 to 99 wt-% of an acid; and (3) about 0.1 to 50 wt-%, based on the organic phase, of a surfactant to stabilize the dispersed inner aqueous phase within the exterior organic phase; and (c) about 0.1 to 25 wt-% of a source of active halogen.

15. The detersive system of claim 14 wherein the alkaline detergent comprises an alkali metal carbonate, an alkali metal bicarbonate, an alkali metal silicate, an alkali metal hydroxide, or mixtures thereof.

16. The detersive system of claim 14 wherein the source of active halogen comprises an alkali metal hypohalide, an alkali metal dihaloisocyanurate, a halogenated alkali metal tripolyphosphate or mixtures thereof.

17. The detersive system of claim 14 wherein the dispersed softening agent comprises droplets having a droplet size of about 0.05 to 2,000 microns.

18. The detersive system of claim 14 wherein the dispersed liquid softening agent comprises droplets having a droplet size of about 1 to 1,000 microns.

19. The detersive system of claim 14 wherein the detersive system is a solid.

20. The detersive system of claim 14 wherein the detersive system is a liquid.

21. The detersive system of claim 14 wherein the organic medium is selected from the group consisting of a liquid paraffinic hydrocarbon, petroleum white oil, a wax, a silicone oil, a halogenated paraffin, a fatty acid and mixtures thereof.

22. The detersive system of claim 14 wherein the complexing agent is selected from the group consisting of an alkyl substituted phosphorous acid compound, an alkyl substituted sulfonic acid compound, a carboxylic acid compound, or salts thereof and mixtures thereof.

23. The detersive system of claim 22 wherein the alkyl substituted phosphorus acid is an alkyl substituted phosphoric acid, alkyl substituted phosphonic acid, alkyl substituted phosphinic acid, salts thereof or mixtures thereof.

24. The detersive system of claim 23 wherein the alkyl substituted phosphoric acid is di-2-ethyl-hexyl-phosphoric acid.

25. The detersive system of claim 14, wherein the acid, of the inner acidic aqueous phase, is selected from the group consisting of hydrochloric acid, sulfuric acid, phosphoric acid, a carboxylic acid compound and mixtures thereof.

26. A detersive laundry system, that can remove soil from fabric and remove divalent ions or trivalent ions from service water, comprising:

(a) about 0.1 to 50 wt-% of a soil removing detergent;

(b) about 0.1 to 95 wt-% of a source of alkalinity; and (c) about 2 to 60 wt-% of a softening agent dispersed within a detersive system comprising:

(1) about 25 to 95 vol.-% of an exterior organic phase which comprises a major proportion of an organic medium, and about 0.5 to 45 wt-% of an organic soluble hardness ion complexing agent;

(2) about 5 to 75 vol.-% of an inner acidic aqueous phase dispersed within the exterior organic solvent phase which comprises water, and about 0.5 to 99 wt-% of an acid; and (3) about 0.1 to 50 wt-%, based on the organic phase, of a surfactant to stabilize the dispersed inner aqueous phase within the exterior phase.

27. The detersive system of claim 26 wherein the soil removing detergent comprises an anionic surfactant, a nonionic surfactant, a cationic surfactant, or mixtures thereof.

28. The detersive system of claim 27 wherein the anionic surfactant comprises an alkyl sulfonate composition, an alkyl benzene sulfonate composition, an alkyl sulphate composition, or mixtures thereof.

29. The detersive system of claim 26 wherein the source of alkalinity comprises an alkali metal carbonate, an alkali metal bicarbonate, an alkali metal silicate, an alkali metal hydroxide and mixtures thereof.

30. The detersive system of claim 26 wherein the dispersed softening agent comprises droplets having a droplet size of about 0.05 to 2,000 microns.

31. The detersive system of claim 26 wherein the dispersed softening agent comprises droplets having a droplet size of about 1 to 1,000 microns.

32. The detersive system of claim 26 wherein the detersive system is a solid.

33. The detersive system of claim 26 wherein the detersive system is a liquid.

34. The detersive system of claim 26 wherein the soil removing detergent comprises an inorganic detergent selected from the group consisting of an alkaline metal silicate, an alkaline metal hydroxide, an alkaline metal carbonate, an alkaline metal bicarbonate, and mixtures thereof.

35. The detersive system of claim 26 wherein the organic medium is selected from the group consisting of a liquid paraffinic hydrocarbon, a napthenic hydrocarbon, petroleum white oil, a wax, a silicone oil, a halogenated paraffin, a fatty acid and mixtures thereof.

36. The detersive system of claim 26 wherein the complexing agent is selected from the group consisting of an alkyl substituted phosphorus acid compound, an alkyl substituted sulfonic acid compound, a carboxylic acid compound, and mixtures thereof.

37. The detersive system of claim 26, wherein the inner acidic aqueous phase acid is selected from the group consisting of hydrochloric acid, sulfuric acid, phosphoric acid, a carboxylic acid compound, a polyacrylic acid compound, and mixtures thereof.

38. The detersive system of claim 26 wherein the surfactant that can stabilize the dispersed inner aqueous phase comprises alkyl substituted polyethylenimine or an alkyl substituted amine.

39. A method of preparing a detersive system, that can remove divalent or trivalent ions from service water and can clean soiled surfaces or articles, comprising dispersing in a soil removing detergent an effective amount of a softening agent product made by combining an exterior organic phase and an interior aqueous phase wherein the exterior organic phase is present at a concentration of about 25 to 95 vol-% and comprises a proportion of an organic medium and about 0.1 to 99 wt-% based on the organic phase of an organic soluble hardness ion complexing agent; wherein the inner aqueous phase comprises 5 to 75 vol-% of the softening agent and comprises a proportion of water and about 0.5 to 99 wt-% based on the aqueous phase of an acid and about 0.1 to 50 wt-% based on the organic phase of a surfactant that can stabilize the dispersed aqueous phase within the exterior organic phase.

40. The detersive system of claim 39 wherein the softening agent comprises droplets having a droplet size of about 0.05 to 2,000 microns.

41. The detersive system of claim 39 wherein the softening agent comprises droplets having a droplet size of about 1 to 1,000 microns.

42. The detersive system of claim 39 wherein the detersive system is a solid.

43. The detersive system of claim 39 wherein the detersive system is a liquid.

44. The detersive system of claim 39 wherein the soil removing detergent comprises a surfactant selected from the group consisting of nonionic surfactant, cationic surfactant, and anionic surfactant and mixtures thereof.

45. The detersive system of claim 39 wherein the soil removing detergent comprises an inorganic detergent selected from the group consisting of an alkaline metal silicate, an alkaline metal hydroxide, an alkaline metal carbonate, an alkaline metal bicarbonate, and mixtures thereof.

46. The detersive system of claim 40 wherein the organic medium is selected from the group consisting of a liquid paraffinic hydrocarbon, a naphthenic hydrocarbon, petroleum white oil, a wax, a silicone oil, a halogenated paraffin, a fatty acid, and mixtures thereof.

47. The detersive system of claim 46 wherein the complexing agent is selected from the group consisting of an alkyl substituted phosphorus acid compound, an alkyl substituted sulfonic acid compound, a carboxylic acid compound, or salts thereof and mixtures thereof.

48. The detersive system of claim 47 wherein the alkyl substituted phosphorus acid is an alkyl substituted phosphoric acid, alkyl substituted phosphonic acid, alkyl substituted phosphinic acid, salts thereof or mixtures thereof.

49. The detersive system of claim 48 wherein the alkyl subtituted phosphoric acid is di-2-ethyl-hexyl-phosphoric acid.

50. The detersive system of claim 43, wherein the acid, of inner acidic aqueous phase, is selected from the group consisting of hydrochloric acid, sulfuric acid, phosphoric acid, a carboxylic acid compound, a polyacrylic acid compound, and mixtures thereof.

51. The detersive system of claim 43 wherein the surfactant that can stabilize the dispersed inner aqueous phase comprises alkyl substituted polyethyleneimine or alkyl substituted amine.

52. A method of cleaning soiled articles or surfaces which comprises dispersing the detersive system of claim 1 in an aqueous medium to form a use composition and contacting the use composition with the soiled article or surface.

* * * * *

UNITED STATES PATENT AND TRADEMARK OFFICE

CERTIFICATE OF CORRECTION

PATENT NO. : 4,793,942

DATED : December 27, 1988

INVENTOR(S) : Keith D. Lokkesmoe and Keith E. Olson

It is certified that error appears in the above-identified patent and that said Letters Patent is hereby corrected as shown below:

Column 6, line 21, for "subtrate" read --substrate--.
Column 12, line 52, for "THe" read --The--.
Column 13, lines 61 and 62, the heading "Grams/Gal" should read --Grains/Gal--.
Column 14, lines 3 and 4, the heading "Grams/Gal" should read --Grains/Gal--.
Column 15, line 5, for "hydrocarbin" read --hydrocarbon--.
Column 15, line 10, for "phosphorus" read --phosphorous--.
Column 16, line 14, for "phosphorus" read --phosphorous--.
Column 16, line 32, for "a" read --the--.
Column 17, line 11, for "phosphorus" read --phosphorous--.
Column 17, lines 43 and 46, for "detersive system" read --method--.
Column 18, lines 1, 3, 5, 10, 16, 21, 26, 31, 34 and 39, for "detersive system" read --method--.
Column 18, line 23, for "phosphorus" read --phosphorous--.
Column 18, line 27, for "phosphorus" read --phosphorous--.

Signed and Sealed this

Fourth Day of July, 1989

*Attest:*

DONALD J. QUIGG

*Attesting Officer*

*Commissioner of Patents and Trademarks*